US008546054B2

(12) United States Patent
Jeong et al.

(10) Patent No.: US 8,546,054 B2
(45) Date of Patent: Oct. 1, 2013

(54) TONER FOR ELECTROPHOTOGRAPHY

(75) Inventors: Jae-hyeuk Jeong, Suwon-si (KR); Duck-hee Lee, Seoul (KR); Deuck-woo Jang, Yongin-si (KR); Jung-ik Choi, Suwon-si (KR); Soon-cheol Jeong, Seongnam-si (KR); Hae-ree Joo, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 965 days.

(21) Appl. No.: 12/239,962

(22) Filed: Sep. 29, 2008

(65) Prior Publication Data

US 2009/0214965 A1 Aug. 27, 2009

(30) Foreign Application Priority Data

Feb. 21, 2008 (KR) ..... 10-2008-0015910

(51) Int. Cl.
*G03G 9/08* (2006.01)

(52) U.S. Cl.
USPC ..... 430/108.3; 430/109.3; 430/109.4; 430/111.4

(58) Field of Classification Search
USPC ..... 430/109.4, 111.4, 108.3, 109.3
See application file for complete search history.

(56) References Cited

U.S. PATENT DOCUMENTS

| | | | | | |
|---|---|---|---|---|---|
| 4,565,763 | A * | 1/1986 | Uchiyama et al. | ..... | 430/109.4 |
| 5,397,671 | A * | 3/1995 | Bayley et al. | ..... | 430/109.4 |
| 5,851,714 | A * | 12/1998 | Taya et al. | ..... | 430/109.4 |
| 5,968,701 | A * | 10/1999 | Onuma et al. | ..... | 430/111.4 |
| 6,007,958 | A * | 12/1999 | Ito et al. | ..... | 430/109.4 |
| 6,692,880 | B2 | 2/2004 | Fields et al. | | |
| 7,871,749 | B2 * | 1/2011 | Choi et al. | ..... | 430/109.4 |
| 2005/0048388 | A1 | 3/2005 | Lee et al. | | |
| 2006/0078812 | A1 * | 4/2006 | Hasegawa et al. | ..... | 430/109.4 |
| 2007/0259283 | A1 * | 11/2007 | Abe et al. | ..... | 430/109.4 |

FOREIGN PATENT DOCUMENTS

| | | |
|---|---|---|
| JP | 2003-262978 | 9/2003 |
| JP | 2006220866 | 8/2006 |
| KR | 20030068617 | 8/2003 |
| KR | 20040098190 | 11/2004 |
| KR | 10-2005-0024670 | 3/2005 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

Diamond, Arthur S & David Weiss (eds.) Handbook of Imaging Materials, 2nd ed.. New York: Marcel-Dekker, Inc. (Nov. 2001) pp. 178-182.*

Notice of Allowance issued in KR Application No. 10-2008-0015910 dated Jan. 30, 2013.

* cited by examiner

*Primary Examiner* — Christopher Rodee
(74) *Attorney, Agent, or Firm* — Stanzione & Kim, LLP

(57) ABSTRACT

An electrophotographic toner includes a binder resin, a colorant, and a releasing agent, wherein the electrophotographic toner has a complex viscosity (η) of 4e2 Pa·s to 8e3 Pa·s at a temperature range of 120 to 160° C. and an angular velocity range of 1.6 to 10 rad/s, a rate of change of the complex viscosity of 165 to 185 Pa·s/° C. at 1.6 rad/s, and 70 to 80 Pa·s/° C. at 10 rad/s within the temperature range, a stress relaxation of 1.0 e3 to 4.5 e4 Pa at a relaxation time of 0.05 to 0.3 seconds under a temperature range of 120 to 160° C., and a rate of change of the stress relaxation (ΔG/ΔT) of 785 to 1000 Pa/° C. at 0.05 seconds and 190 to 215 Pa/° C. at 0.3 seconds within the temperature range above.

2 Claims, 2 Drawing Sheets

TONER FOR ELECTROPHOTOGRAPHY

CROSS-REFERENCE TO RELATED APPLICATIONS

This application claims priority under 35 U.S.C. §119(a) from Korean Patent Application No. 10-2008-0015910, filed on Feb. 21, 2008, in the Korean Intellectual Property Office, the disclosure of which is incorporated herein in its entirety by reference.

BACKGROUND OF THE INVENTION

1. Field of the Invention

The present general inventive concept relates to an electrophotographic toner, and more particularly, to an electrophotographic toner having properties so as to obtain a stable fixed image and printing quality in a fixating system with a multiple pressure configuration.

2. Description of the Related Art

An image forming apparatus such as an electrophotographic device or an electrostatic recording device forms an electrostatic latent image by executing an image exposure on a photoreceptor homogenously charged, and attaches a toner on the electrostatic latent image in a toner image, and the toner image is transferred on to a transfer material such as transfer paper. Sequentially, a non-fixed toner image is fixed on the transfer material using a variety of methods such as heating, pressing, or solvent steaming. In most cases, the fixing process includes passing the transfer material, on which toner image has been transferred, between a fixing roller and a pressure roller, and fusing the toner on the transfer material by heat-pressing. Then, the fixating toner is fixed on the transfer material depending on fixing conditions to form a stable image.

The heat fixing method using a heating roller or a film requires high heat efficiency in order to fuse and attach the toner image on a fixing sheet when the heating roller or the film surface is in contact with the toner image. In case of the heat fixing method, an increase in a heat capacity of a heat fixing unit is needed in order to prevent fixture failure caused by fixation at a low temperature condition and passing of the fixing sheet. Therefore, maintaining a fixation property while achieving low power consumption greatly depends on improvement of the toner, and particularly, on a low temperature fixation property of the toner.

For example, in the pressure-heat fixing method, the high-temperature roller surface and the toner image come in contact under pressure in a fused form, and thus a portion of the toner is transferred and adhered to a surface of the fixing roller, and then, is re-transferred on a successive fixing sheet, thereby contaminating the fixing sheet. This is referred to as an offset, which is greatly affected by a temperature and a speed of fixing. Generally, the surface temperature of the fixing roller is set low when the fixing speed is low, and is set high when the fixing speed is high. This is because a constant energy is supplied to the toner image in order to fix the toner image, regardless of a difference in the fixing speed.

In order to solve the problems above, the fixing temperature was generally increased when the fixing speed was high, in order to promote fixation of the toner on the fixing sheet. According to the method, the heating roller temperature can be lowered to some extent, and high temperature offsetting of the top portion of a toner layer can be prevented. However, when a very high electrical output is applied to the toner layer, a number of difficult problems such as an easily occurring winding offset involving that the fixing sheet is wrapped around the fixing roller, and a trace of means separating the fixing sheet from the fixing roller onto the fixed image may easily occur.

In particular, in the case of a 3-roller/belt fixing system as an example of a fixing system with multiple pressure configuration, as illustrated in FIG. 1, and not a fixing system having a symmetrical single pressure distribution such as a 2-roller (1 heater-roller+1 pressure-roller) system, a melting strength critically affects a quality of the printing.

In this case, the 3-roller/belt fixing system has consecutive or non-consecutive multiple nips, and thus the toner that melted in the first nip is secondarily fixed by a pressure applied in the second nip. Such a multiple fixing system is beneficial in that an initial unnecessary pressure is removed as compared to that of a single fixing system, but during a return from the first nip to the second nip, a stable transfer of the image and paper separability must be attained beforehand. To be suitable for such a system, a toner having a sufficient melting property at a first pressure-applying unit, and sufficient paper separability (anti-wrap jam) and a stable image (anti-blurring) at a second pressure-applying unit is necessary.

SUMMARY OF THE INVENTION

The present general inventive concept provides an electrophotographic toner having an improved fixation property in a fixation system with a multiple pressure configuration, thereby preventing an incidence of offsetting, and having sufficient paper separability.

The present general inventive concept also provides an image forming method of the electrophotographic toner.

The present general inventive concept also provides an image forming device including the electrophotographic toner.

Additional aspects and utilities of the present general inventive concept will be set forth in part in the description which follows and, in part, will be obvious from the description, or may be learned by practice of the general inventive concept.

The foregoing and/or other aspects and utilities of the general inventive concept may be achieved by providing an electrophotographic toner including a binder resin, a colorant, and a releasing agent, wherein a complex viscosity ($\eta$) is 4e2 Pa·s to 8e3 Pa·s at a temperature range of 120 to 160° C. and an angular velocity range of 1.6 to 10 rad/s, a rate of change of the complex viscosity within the temperature range may be 165 to 185 Pa·s/° C. at 1.6 rad/s, and 70 to 80 Pa·s/° C. at 10 rad/s, a stress relaxation at a relaxation time of 0.05 to 0.3 seconds under a temperature range of 120 to 160° C. may be 1.0 e3 to 4.5 e4 Pa, and a rate of change of the stress relaxation ($\Delta G/\Delta T$) within the temperature range is 785 to 1000 Pa/° C. at 0.05 seconds and 190 to 215 Pa/° C. at 0.3 seconds.

The binder resin may have a weight average molecular weight of 3,000 to 200,000 and a gel content of 1 to 10%.

The binder resin may include a first binder resin having a weight average molecular weight of 90,000 to 150,000 and a gel content of 5 to 10%, and a second binder resin having a weight average molecular weight of 5,000 to 60,000 and a gel content of 1 to 3%, and a weight ratio between the first binder resin and the second binder resin may be 8:2 to 5:5.

A content of the releasing agent may be 1 to 4 parts by weight based on 100 parts by weight of the binder resin.

The toner may be applied to a fixation system having a multiple pressure configuration.

The foregoing and/or other aspects and utilities of the general inventive concept may also be achieved by providing an image forming method including forming a visible image by attaching a toner on a surface of a photoreceptor on which an electrostatic latent image is formed, and transferring the visible image to a transfer material, wherein the toner is an electrophotographic toner including a binder resin, a colorant, and a releasing agent, wherein a complex viscosity (η) is 4e2 Pa·s to 8e3 Pa·s at a temperature range of 120 to 160° C. and an angular velocity range of 1.6 to 10 rad/s, a rate of change of the complex viscosity within the temperature range is 165 to 185 Pa·s/° C. at 1.6 rad/s, and 70 to 80 Pa·s/° C. at 10 rad/s, a stress relaxation at a relaxation time of 0.05 to 0.3 seconds under a temperature range of 120 to 160° C. is 1.0 e3 to 4.5 e4 Pa, and a rate of change of the stress relaxation (ΔG/ΔT) within the temperature range is 785 to 1000 Pa/° C. at 0.05 seconds and 190 to 215 Pa/° C. at 0.3 seconds.

The foregoing and/or other aspects and utilities of the general inventive concept may also be achieved by providing an image forming device including an organic photoreceptor, an image forming unit to form an electrostatic latent image on a surface of the organic photoreceptor, a toner accommodating unit to contain a toner, a toner supplying unit to supply the toner on to the organic photoreceptor in order to develop the electrostatic latent image on the surface of the organic photoreceptor into a toner image, and a toner transferring unit to transfer the toner image from the surface of the organic photoreceptor to the transfer material, wherein the toner includes a binder resin, a colorant, and a releasing agent, wherein a complex viscosity (η) is 4e2 Pa·s to 8e3 Pa·s at a temperature range of 120 to 160° C. and an angular velocity range of 1.6 to 10 rad/s, a rate of change of the complex viscosity within the temperature range is 165 to 185 Pa·s/° C. at 1.6 rad/s, and 70 to 80 Pa·s/° C. at 10 rad/s, a stress relaxation at a relaxation time of 0.05 to 0.3 seconds under a temperature range of 120 to 160° C. is 1.0 e3 to 4.5 e4 Pa, and a rate of change of the stress relaxation (ΔG/ΔT) within the temperature range is 785 to 1000 Pa/° C. at 0.05 seconds and 190 to 215 Pa/° C. at 0.3 seconds.

The foregoing and/or other aspects and utilities of the general inventive concept may also be achieved by providing an electrophotographic toner including a binder resin, a colorant, and a releasing agent, wherein at least one of the binder resin has a weight average molecular weight of 3,000 to 200,000 and a gel content of 1 to 10, and a content of the releasing agent is 1 to 4 parts by weight based on 100 parts by weight of the binder resin.

BRIEF DESCRIPTION OF THE DRAWINGS

The above and other features and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
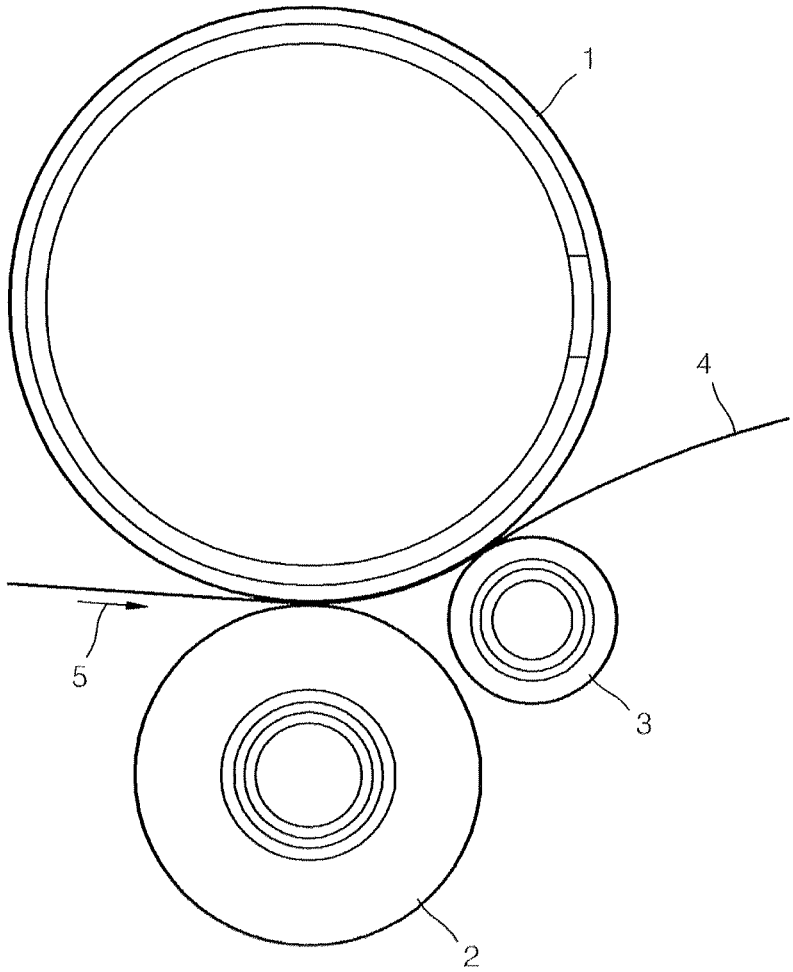
FIG. 1 is a schematic diagram illustrating a three-roller/belt fixation system.

Reference will now be made in detail to embodiments of the present general inventive concept, examples of which are illustrated in the accompanying drawings, wherein like reference numerals refer to the like elements throughout. The embodiments are described below in order to explain the present general inventive concept by referring to the figures.

An embodiment of the present general inventive concept provides an electrophotographic toner including a binder resin, a colorant, and a releasing agent, wherein a complex viscosity (η) is 4e2 Pa·s to 8e3 Pa·s at a temperature range of 120 to 160° C. and an angular velocity range of 1.6 to 10 rad/s, a rate of change of the complex viscosity within the temperature range is 165 to 185 Pa·s/° C. at 1.6 rad/s, and 70 to 80 Pa·s/° C. at 10 rad/s, a stress relaxation at a relaxation time of 0.05 to 0.3 seconds under a temperature range of 120 to 160° C. is 1.0 e3 to 4.5 e4 Pa, and a rate of change of the stress relaxation (ΔG/ΔT) within the temperature range is 785 to 1000 Pa/° C. at 0.05 seconds and 190 to 215 Pa/° C. at 0.3 seconds.

The electrophotographic toner according to the present embodiment may be applied to a fixation system with a multiple pressure configuration. The fixation system with a multiple pressure configuration refers to a multiple asymmetrical/symmetrical pressure configuration which, unlike a single symmetrical pressure system having each of a heater roller and a pressure roller, has two or more nips by including two or more pressure rollers and one heater roller, or two or more heater rollers and one pressure roller. As a result, the fixation system having the multiple pressure configuration has two or more pressure peaks.

As an example of the multiple pressure configuration, a three-roller/belt fixation system is illustrated in FIG. 1. The three-roller/belt fixation system has a configuration of a pressure roller 2 and a post-pressure roller 3 which are combined with a heater roller 1. As a print media 4, to which an image formed of a non-fixed toner is transferred through a transferring unit of an image forming device, proceeds in a print media proceeding direction 5, passing a first nip which is an area of contact between the heater roller 1 and the pressure roller 2, and a second nip which is an area of contact between the heater roller 1 and the post-pressure roller 3, the toner experiences heat and pressure and becomes fixed to the print media 4.

Here, the fixation system having a multiple pressure configuration such as the three-roller/belt fixation system has consecutive or non-consecutive multiple nips, and thus a stable image transfer and paper separability must be assured during the process of returning from the first nip to the second or subsequent nips. The present embodiment is able to provide an electrophotographic toner which, by controlling rheological characteristics of the toner, such as a complex viscosity and a stress relaxation, prevents an occurrence of offsetting, and has sufficient paper separability.

Measurement of the complex viscosity may be obtained with a temperature distribution measurement using a sine wave oscillation with an oscillation frequency in a range of 1.6 to 10 rad/s, and is measured using an ARES measurement apparatus manufactured by Rheometric Scientific.

In addition, the complex viscosity is measured within the temperature range of 120 to 160° C., and this temperature range is set to −40 to −20° C. lower than the temperature of fixation, considering an inherent temperature of the fixation environment of the toner by an incomplete heat transfer, and a history of temperature increase of the toner.

At a temperature range of 120 to 160° C., and an angular velocity in a range of 1.6 to 10 rad/s, the complex viscosity (η) may be 4e2 Pa·s to 8e3 Pa·s, such as 450 Pa·s to 7,800 Pa·s, including 475 to 7,750 Pa·s.

The complex viscosity depends on a temperature at measurement and an angular velocity conditions, such that when the temperature at measurement and the angular velocity increase, the complex viscosity decreases, and when the temperature at measurement and the angular velocity decrease, the complex viscosity increases.

If the complex viscosity is less than 4e2 Pa·s, a cohesiveness of the binder resin becomes too low, such that an offsetting occurs at a high temperature region, or a wrap jam is exhibited due to the lessened paper separability at a final nip. If the complex viscosity is greater than 8e3 Pa·s, the cohesiveness of the binder resin becomes too large, and as a result, adhesion between the image media and the toner decreases less than the adhesion between the toner and the rollers, such that an offsetting may occur, or surface glossiness and optimal fixation hardness of a final fixed image is difficult to obtain.

Moreover, in terms of the viscosity behavior of the toner, an image quality is affected by not only a range of viscosity under a condition of a temperature of 120 to 160° C. and an angular velocity of 1.6 to 10 rad/s, but also by a degree of change of the complex viscosity following the temperature change within the temperature and the angular velocity above.

A rate of change of the complex viscosity within the temperature range may be represented by the formula below:

$$\Delta\eta^*/\Delta T=|(\eta^*_{end}-\eta^*_{init})/(T_{end}-T_{init})|$$

wherein $T_{init}$ represents an initial temperature in the temperature interval during which the rate of change of the complex viscosity is measured, and $T_{end}$ represents an ending temperature in the temperature interval during which the rate of change of the complex viscosity is measured.

Furthermore, $\eta^*_{init}$ refers to a complex viscosity of the toner at an initial temperature, and $\eta^*_{end}$ refers to a complex viscosity of the toner at an end temperature.

In the current embodiment of the present general inventive concept, a temperature interval at which the rate of change of the complex viscosity is measured is 120 to 160° C., therefore $T_{init}$ is 120° C. and $T_{end}$ is 160° C.

From $\Delta\eta^*/\Delta T$, the viscosity behaviour of the toner can be observed, while the toner, that is non-fixed on the paper, passes the first nip through the final nip of the fixation system having a multiple pressure configuration, within the temperature interval of $T_{init}$ to $T_{end}$.

The $\Delta\eta^*/\Delta T$ of the electrophotographic toner according to the present embodiment is 165 to 185 Pa·s/° C. at 1.6 rad/s, and 70 to 80 Pa·s/° C. at 10 rad/s, including, 165 to 180 Pa·s/° C. at 1.6 rad/s, and 72 to 79 Pa·s/° C. at 10 rad/s.

If the $\Delta\eta^*/\Delta T$ is lower than 165 Pa·s/° C., the viscosity of the toner decreases relatively gradually as the temperature increases, and therefore it becomes difficult to obtain a sufficient glossy effect or fixation effect at low change speed driving of complex viscosity, and if the $\Delta\eta^*/\Delta T$ is greater than 185 Pa·s/° C., the viscosity of the toner decreases relatively drastically, thereby a hot offsetting, a wrap jam or narrow temperature region of fixation may occur. Moreover, if the $\Delta\eta^*/\Delta T$ is less than 70 Pa·s/° C. at 10 rad/s, obtaining glossiness effects or fixation effects at normal speed driving is difficult, and if the $\Delta\eta^*/\Delta T$ is greater than 80 Pa·s/° C., hot offsetting or a wrap jam may occur, producing an inconsistent image.

Furthermore, stress relaxation refers to a change in an elasticity with respect to time in which the toner stays within the fixing unit, that is, a power required to maintain a reduction of strain with respect to a time when a predetermined strain is applied to the toner.

According to the present embodiment, because the condition of fixation is not solely dependent on the viscosity measured when the toner has a stable viscoelastic behavior after a predetermined time, but is dependent on a property of the toner before stabilization for a very short time, a specific significance of stress relaxation is in observing a time dependency of the viscoelasticity with respect to a fixation condition, even at an optimum viscosity.

According to another embodiment of the present general inventive concept, the stress relaxation at a relaxation time of 0.05 to 0.3 seconds and under a temperature range of 120 to 160° C. is 1.0 e3 to 4.5 e4 Pa, including 1.2e3 to 4.3e4 Pa.

Here, the relaxation time of 0.05 to 0.3 seconds, which becomes a reference for measuring the stress relaxation, refers to a time taken by the non-fixed image to pass through the fixation nip and be heat-rolled, which includes a range of total time taken from passing through a first pressure applying unit to passing through a final applying unit.

If the stress relaxation is less than 1.0 e3 Pa, the paper separability at the final nip is decreased, causing a wrap jam or a hot offsetting, and if the stress relaxation is greater than 4.5 e4 Pa, an image distortion or a surface roughness/loss of glossiness may occur, due to a cold offsetting at the first nip.

Moreover, in view of the stress relaxation behavior of the toner, an image quality may not only be affected by the range of the stress relaxation within conditions of the temperature of 120 to 160° C., and a relaxation time of 0.05 to 0.3 seconds, but may also be affected by a degree of change in the stress relaxation with respect to temperature change within ranges of the temperature and the relaxation time.

A rate of change of the stress relaxation ($\Delta G/\Delta T$) within the temperature range may be represented by a formula below:

$$\Delta G/\Delta T=|(G_{end}-G_{init})/(T_{end}-T_{init})|$$

wherein $T_{init}$ represents an initial temperature of the temperature interval at which the rate of change of the stress relaxation is measured, and $T_{end}$ represents an end temperature of the temperature interval at which the rate of change of the stress relaxation is measured.

Moreover, $G_{init}$ represents a stress relaxation of the toner at the initial temperature, and $G_{end}$ represents a stress relaxation of the toner at the ending temperature.

The temperature interval at which the rate of change of stress relaxation is measured in the present embodiment is in the range of 120 to 160° C., the $T_{init}$ is 120° C., and $T_{end}$ is 160° C.

From $\Delta G/\Delta T$, the stress relaxation behaviour of the toner can be observed, while the toner, which is non-fixed on the paper, passes the first nip through the final nip of the fixation system having a multiple pressure configuration, within the temperature interval of $T_{init}$ to $T_{end}$.

The $\Delta G/\Delta T$ of the electrophotographic toner according to the present embodiment may be 785 to 1000 Pa/° C., such as 790 to 900 Pa·s/° C., including 790 to 850 Pa·s/° C. at 0.05 seconds, and 190 to 215 Pa/° C., preferably 192 to 215 Pa·s/° C., and more preferably 192 to 210 Pa·s/° C. at 0.3 seconds.

If the $\Delta G/\Delta T$ is less than 785 Pa·s/° C. at 0.05 seconds, obtaining a sufficient image glossiness due to unstable image fixation at the first nip is difficult, and if the $\Delta G/\Delta T$ is greater than 1,000 Pa·s/° C. at 0.05 seconds, maintaining the stability of the image in terms of a wrap jam is difficult, an offset, a narrow fixation window, etc. If the $\Delta G/\Delta T$ is less than 190 Pa·s/° C. at 0.3 seconds, a change in the viscosity while passing through the fixation unit is insignificant, possibly causing an incomplete fixation, offsetting, or image quality deterioration, and if the $\Delta G/\Delta T$ is greater than 215 Pa·s/° C. at 0.3 seconds, a region of fixation with respect to a rapid change in viscosity may become narrow.

According to the present embodiment, the fixation effect can be generalized and the toner quality can be assessed by comprehensively defining a relationship between heat properties and rheological properties of the toner according to the fixation environment.

The electrophotographic toner according to an embodiment of the present general inventive concept includes a binder resin, a colorant, and a releasing agent, each of which will be described hereinafter.

The binder resin may be various conventional resins, and may include, for example, styrene-based copolymers including polystyrene, poly-p-chlorostyrene, poly-α-methylstyrene, styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinylmethylether copolymer, styrene-vinylethyl ether copolymer, styrene-vinylethylketone copolymer, styrene-butadiene copolymer, styrene-acrylnitrile-indene copolymer, styrene-maleate copolymer, and styrene-maleate ester, polymethyl methacrylate, polyethyl methacrylate, polybutyl methacrylate, copolymers thereof, polyvinyl chloride, polyvinyl acetate, polyethylene, polypropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, paraffin chloride, and paraffin wax may be used individually or as a mixture. Among these, polyester-based resin is suitable as a color developing agent due to superior fixation properties and transparency thereof.

The binder resin is selected in order to manufacture a toner having a desirable complex viscosity and stress relaxation.

According to an embodiment of the present general inventive concept, the binder resin may have a weight-average molecular weight of 3,000 to 200,000, such as, 5,000 to 150,000, and a gel content of 1 to 10%.

If the weight-average molecular weight of the binder resin is less than 3,000, weak mechanical properties of the low molecular weight causes a decrease in a viscosity at a high temperature environment, and a hot offset may occur which is not desirable, and if the weight-average molecular weight is greater than 200,000, a relatively large amount of energy must be supplied in order to obtain an optimum melting viscosity, which limits an increase of the fixation temperature and an applicability of the toner to high-speed apparatuses.

Here, a gel content (%) refers to a weight content of the binder resin dissolved in an organic solvent and does not precipitate out from the solvent.

The gel content of the binder resin may be measured using the following method.

The weight of the binder resin is measured, and then soluble matter of the binder resin is extracted for 24 hours using a Soxhlet extraction method. The solvent used in the extraction may include an additive included in the binder resin and the binder resin. For example, if the binder resin is styrene copolymer, acrylic resin, or denatured polyphenylene ether, toluene is used as the solvent; if the binder resin is olefin copolymer or polyacetal, trichlorobenzene may be used as the solvent; and if the binder resin is polyamide, hexafluoroisopropanol may be used as the solvent.

After extraction, all residual materials yielded are washed with acetone, and are vacuum dried at 140° C. to yield the dried material. A weight of the dried material is measured, which is taken as the dry weight after extraction. The gel content (%) may be calculated by an Equation 1 below:

$$\text{Gel content (\%)} = (\text{dry weight of binder resin after extraction})(g)/(\text{initial weight of the binder resin})(g) \times 100 \quad \text{<Equation 1>}$$

If the gel content of the binder resin is less than 1%, stabilizing the physical properties at a high temperature is difficult, and if the content is greater than 10%, a relatively large amount of energy must be supplied in order to ensure an optimum melting viscosity, limiting the increase of the fixation temperature and an applicability to high-speed apparatuses, and causing dispersity of additives to be poor.

According to another embodiment of the present general inventive concept, the binder resin is a mixture of a first binder resin and a second binder resin, each having a different weight-average molecular weight and gel content (%). The reason of using the mixture of the first binder resin and the second binder resin is to implement a resin system which is able to complement the faults of a single resin, and because controlling properties by contents thereof is easy.

Therefore, according to another embodiment of the present general inventive concept, the binder resin may include a first binder resin having a weight-average molecular weight of 90,000 to 150,000 and a gel content of 5 to 10%, and a second binder resin having a weight-average molecular weight of 5,000 to 60,000 and a gel content of 1 to 3%.

Here, a weight ratio between the first binder resin and the second binder resin may be 8:2 to 5:5, such as 7:3 to 6:4. If the weight ratio is less than 5:5, a temperature range of fixation may be narrowed or a durability may be weakened, and if the weight ratio is greater than 8:2, the fixation properties or print glossiness may become poor.

Moreover, a colorant may be carbon black or aniline black in the case of a black toner, and a nonmagnetic toner according to the present embodiment can be manufactured into a color toner. In addition, when the color toner is used, the black color among the colorants may be carbon black, and may further include yellow, magenta, and cyan colorants as colors.

The yellow colorant may include a condensed nitrogen compound, an isoindolinone compound, a anthraquinone compound, an azo metal dye, and an allyl imide compound. Specifically, C.I. pigments yellow 12, 13, 14, 17, 62, 74, 83, 93, 94, 95, 109, 110, 111, 128, 129, 147, 168, and 180 may be used.

The magenta colorant may include a condensed nitrogen compound, an anthraquinone compound, a quinacridone compound, a base dye lake compound, a naphthol compound, a benzo imidazole compound, a thioindigo compound and a perylene compound. Specifically, C.I. pigments red 2, 3, 5, 6, 7, 23, 48:2, 48:3, 48:4, 57:1, 81:1, 122, 144, 146, 166, 169, 177, 184, 185, 202, 206, 220, 221 or 254 may be used.

The cyan colorant may include a copper phthalocyanine compound and derivatives thereof, an anthraquinone compound, and a base dye lake compound. Specifically, C.I. pigments blue 1, 7, 15, 15:1, 15:2, 15:3, 15:4, 60, 62, or 66 may be used.

Each of the colorants may be used on separately or in a mixture of two or more compounds, which is selected with consideration of a hue, saturation, lightness, weather resistance, and dispersity within the toner.

A content of the colorant may be 0.1 to 20 parts by weight, such as 1 to 5 parts by weight based on 100 parts by weight of the binder resin. The content of the colorant can be flexible as long as the content of the colorant is sufficient enough to color the toner, and if the content is less than 0.1 parts by weight based on 100 parts by weight of the binder resin, a coloring effect is not sufficient, and if the content is greater than 20 parts by weight based on 100 parts by weight of the binder resin, the dispersity of the colorant within the toner becomes poor, and therefore may cause a non-uniform frictional charging.

The releasing agent may be used in order to manufacture toner composition having a desirable complex viscosity and a releasing property during fixation. Although the releasing agent according to an embodiment of the present general inventive concept is not limited to the above, an appropriate releasing agent providing properties to attain a purpose of the final toner composition may be selected. Examples of the releasing agent that may be used include, but are not limited to, polyethylene-based wax, polypropylene-based wax, silicon wax, paraffin wax, ester-based wax, carnauba wax and metallocene wax. A melting point of the releasing agent, for example, may be approximately 50 to 150° C. The releasing agent composition physically adheres to the toner particles, but does not covalently bond with the toner particles. By using the releasing agent, a toner which is fixed on a final image receptor at a low fixing temperature, and produces a highly durable and abrasion-resistant final image can be provided.

The releasing agent may typically be included at 1 to 4 parts by weight such as 2 to 3 parts by weight based on 100 parts by weight of the binder resin. If a content of the releasing agent is less than 1 parts by weight based on 100 parts by weight of the binder resin, an anti-offset effect is reduced, and if the content is greater than 4 parts by weight based on 100 parts by weight of the binder resin, storability and durability may weaken.

Moreover, the electrophotographic toner according to an embodiment of the present embodiment may further include a charge controlling agent. that may be selected from the group consisting of zinc or aluminum containing a salicylic acid compound, a boric complex of bis diphenyl glycolic acid, and silicate. More specifically, the charge controlling agent may be a zinc dialkyl salicylic acid, boro bis (1,1-diphenyl-1-oxo-acetyl potassium salt or the like. The content of the charge controlling agent may typically be 0.5 to 2 parts by weight, and preferably 1 to 1.5 parts by weight based on 100 parts by weight of the binder resin. If the charge controlling agent content is less than 0.5 parts by weight based on 100 parts by weight of the binder resin, attaining the entire charge amount becomes difficult, and if the content is greater than 2 parts by weight based on 100 parts by weight of the binder resin, overcharging and dispersibility may be affected.

According to another embodiment of the present general inventive concept, there is provided a method of forming an image, the method including forming a visible image by attaching a toner on a surface of a photoreceptor on which an electrostatic latent image is formed; and transferring the visible image to a transfer material, wherein the toner is an electrophotographic toner including a binder resin, a colorant, and a releasing agent and has a complex viscosity (η) of 4e2 Pa·s to 8e3 Pa·s at a temperature range of 120 to 160° C. and an angular velocity range of 1.6 to 10 rad/s, the rate of change of the complex viscosity within the temperature range is 165 to 185 Pa·s/° C. at 1.6 rad/s, and 70 to 80 Pa·s/° C. at 10 rad/s, stress relaxation at a relaxation time of 0.05 to 0.3 seconds under a temperature range of 120 to 160° C. is 1.0 e3 to 4.5 e4 Pa, and the rate of change of the stress relaxation (ΔG/ΔT) within the temperature range is 785 to 1000 Pa/° C. at 0.05 seconds and 190 to 215 Pa/° C. at 0.3 seconds.

A representative electrophotographic image forming process includes charging, exposing, developing, transferring, fixing, cleaning, and erasing, and includes a series of image-forming processes on the photoreceptor.

In the charging process, the photoreceptor is conventionally covered by a polar charge of choice of either positive or negative charges, by a corona or a charge roller. In the exposing process, an optical system, which is conventionally a laser scanner or a diode arrangement, forms a latent image by selectively discharging a charge surface of the photoreceptor in an image-wise manner corresponding to a target image to be formed on a final image receptor. The electronic irradiation, which can be considered as "light", may include, for example, infrared irradiation, visible light, and ultraviolet irradiation.

During the developing process, the toner particles, with appropriate polarity, generally contact with the latent image on the photoreceptor, for which a conventional electrically-biased developer having the same potential polarity as the toner polarity is used. The toner particles are transferred to the photoreceptor, and are selectively attached to the latent image by an electrostatic force, forming the toner image on the photoreceptor.

During the transferring process, the toner image is transferred to the targeted final image receptor, wherein an intermediate transferring element is often used in order to affect the transfer of the toner image from the photoreceptor, along with the transfer following the toner image.

During the fixing process, the toner image on the final image receptor is heated to soften or melt the toner particles, thereby fixing the toner image to the final receptor. Another method of fixing includes setting the toner on the final receptor under high pressure with or without applying heat.

During the cleaning process, residual toner remaining on the photoreceptor is removed.

Finally, the discharging process involves practically reducing the photoreceptor charge uniformly to a low level by being exposed to a light of a particular wavelength band, thereby removing residues of the earlier latent image, and preparing the photoreceptors for the next image-forming cycle.

According to another embodiment of the present general inventive concept, there is provided an image forming device including an organic photoreceptor; an image forming unit to form an electrostatic latent image on a surface of the organic photoreceptor; a toner accommodating unit to contain a toner; a toner supplying unit to supply the toner to the organic photoreceptor in order to develop the electrostatic latent image on the surface of the organic photoreceptor into a toner image; and a toner transferring unit to transfer the toner image from the surface of the organic photoreceptor to a transfer material, wherein the toner is an electrophotographic toner including a binder resin, a colorant, and a releasing agent, and having a complex viscosity (η) of 4e2 Pa·s to 8e3 Pa·s at a temperature range of 120 to 160° C. and an angular velocity range of 1.6 to 10 rad/s, a rate of change of the complex viscosity within the temperature range is 165 to 185 Pa·s/° C. at 1.6 rad/s, and 70 to 80 Pa·s/° C. at 10 rad/s, a stress relaxation at a relaxation time of 0.05 to 0.3 seconds under a temperature range of 120 to 160° C. is 1.0 e3 to 4.5 e4 Pa, and the rate of change of the stress relaxation (ΔG/ΔT) within the temperature range is 785 to 1000 Pa/° C. at 0.05 seconds and 190 to 215 Pa/° C. at 0.3 seconds.

Figure 2:
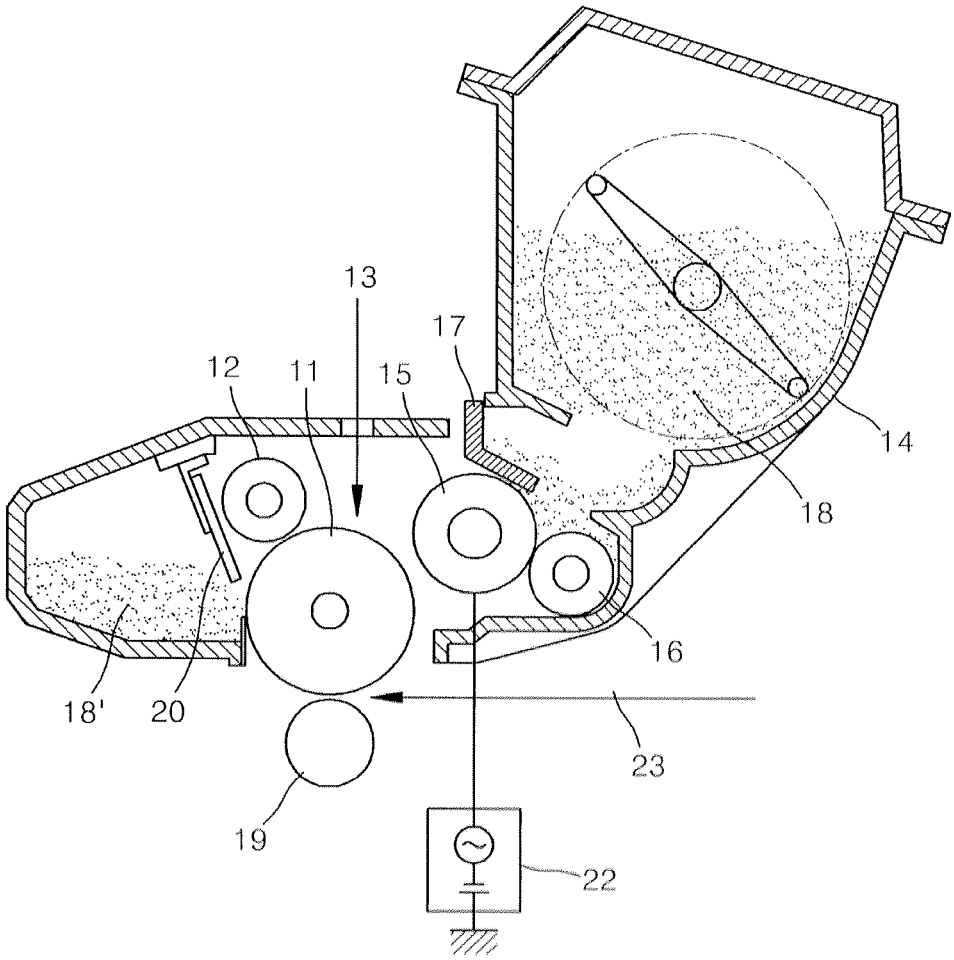
FIG. 2 is a diagram illustrating an image forming device accommodating a toner manufactured according to an embodiment of the present general inventive concept.

FIG. 2 is a diagram illustrating a non-contact developing type image forming device accommodating a toner manufactured according to an embodiment of the present general inventive concept. The operating principles of the non-contact developing type image forming device are as follows. In the image forming device, a non-magnetic mono-component developing agent 18 of a developing apparatus 14 is supplied to a developing roller 15 by a supply roller 16 composed of elastic material such as polyurethane foam or sponge. The developing agent 18, supplied to the developing roller 15, reaches an area of contact between a developing agent regulating blade 17 and the developing roller 15 according to the rotation of the developing roller 15. The developing agent regulating blade 17 is composed of metal or a material such as rubber. When the developing agent 18 passes through the area of contact between the developing agent regulating blade 17 and the developing roller 15, the developing agent 18 is regulated to be formed into a constant thin layer and be sufficiently charged. The thin-layered developing agent 18 is transferred to the developing region by the developing roller 15, where the developing agent 18 is developed on an electrostatic latent image of a photoreceptor 11, which is a latent image support. Here, the electrostatic latent image is formed by scanning light 13 to the photoreceptor 11.

The developing roller 15 and the photoreceptor 11 maintain a predetermined distance without contact, and are located facing each other. The developing roller 15 rotates in an anti-clockwise direction and the photoreceptor 11 rotates in a clockwise direction.

The developing agent 18, transferred to the developing region of the photoreceptor 11, develops an electrostatic latent image formed on the photoreceptor 11 due to an electrical energy generated by a potential difference between a DC-overlapped AC voltage applied by a power supply 22 on the developing roller 15 and the latent image potential of the photoreceptor 11 charged by a charging unit 12, thereby forming a toner image.

The developing agent 18 developed on the photoreceptor 11 reaches the location of a transferring unit 19 according to a rotating direction of the photoreceptor 11. A print paper 23 passes through a transferring unit 19 in which a reverse polar high voltage is applied against the developing agent 18 developed on the photoreceptor 11 in a form of corona discharge or a roller, and thereby transferring the developing agent 18 onto the print paper 23 so as to form an image.

The image transferred to the print paper 23 passes through a high temperature, high pressure fixing apparatus (not illustrated), such that the developing agent 18 is fused on the print paper 23 and thus the image is fixed. Meanwhile, a residual developing agent 18', on the developing roller 15 that has not been developed, is recovered by the supply roller 16 in contact with the developing roller 15, and the residual developing agent 18' on the photoreceptor 11 that has not been developed is collected by a cleaning blade 20. The above processes are repeated.

The present embodiment will now be described in more detail with reference to the following examples. However, these examples are for illustrative purposes only and are not intended to limit the scope of the general inventive concept.

EXAMPLES

Example 1

A binder resin was prepared by mixing two polyester-series resins: a first binder resin (Samyang Co., MH141, weight average molecular weight (MW) 103,530, gel content: 5%) and a second binder resin (Samyang Co., ML121, weight average molecular weight 40,000, gel content: 3%), at a weight ratio of 7:3.

Along with the binder resin, 1 part by weight of carbon black (Cabot Co., Mogul-L) as a colorant, 1 part by weight of LR-147 by Carlit Co. as a charge controlling agent, and 2.5 parts by weight of a mixture of We3 (product name) by Nof Co. and H1N4 (product name) by Sasol at a ratio of 9:1 were used as a releasing agent. Then, the binder resin, the colorant, the charge controlling agent and the releasing agent were mixed together, and were extruded using an extruder PCM30 by Ikega Co., under the following conditions:

feeding speed 3 rpm, screw speed 200 rpm, extrusion temperature including inlet temperature of 40° C., transfer region temperature of 80 to 100° C., and outlet temperature of 150° C.

Next, the extruded product was ground to 5 to 10 μm to manufacture a toner.

Example 2

A toner was manufactured using the same conditions as in Example 1, except that the weight ratio between the first binder resin and the second binder resin was 8:2.

Example 3

A toner was manufactured using the same conditions as in Example 1, except that the binder resin was prepared by mixing two polyester-series resins: a first binder resin (Samyang Co., MH141, weight average molecular weight (MW) 103,530, gel content: 5%) and a second binder resin (Samyang Co., ML121, weight average molecular weight 40,000, gel content: 3%), at a weight ratio of 6:4.

Comparative Example 1

A toner was manufactured using the same conditions as in Example 1, except that the binder resin was prepared using a polyester-series resin (Samyang Co. LL, weight average molecular weight (MW) 2,900, gel content: less than 1%).

Comparative Example 2

A toner was manufactured using the same conditions as in Example 1, except that the binder resin was prepared using a polyester-series resin (Samyang Co. HH, weight average molecular weight (MW) 210,000, gel content: 7%).

Comparative Example 3

A toner was manufactured using the same conditions as in Example 1, except that the binder resin was prepared using two polyester-series resins, a first binder resin (Samyang Co., HH, weight average molecular weight (MW) 210,000, gel content: 7%) and a second binder resin (Samyang Co. LL, weight average molecular weight (MW) 2,900, gel content: less than 1%) at a weight ratio of 6:4.

Method of Evaluating the Toners

<Measurement of Complex Viscosity>

Complex viscosity was measured using an ARES measuring device by Rheometric Scientific. The time of measurement was 30 seconds, and keeping the range of temperature error within 1° C. since an initiation of measurement attained a measuring accuracy. A sample, in a form of a powder, was inserted between two round discs of 25 mm in diameter, and a dynamic viscosity was measured at a linear region.

The samples were measured directly in a powder form in order to minimize an addition/removal of heat by hysteresis during preparation of the samples, and to accurately measure properties of the prepared toner. The dynamic viscosity was measured at a condition where a test angular velocity equals a rotational angular velocity of the fixing apparatus at a strain of 5% or less, and the results are illustrated in Table 1.

TABLE 1

| Samples | Complex Viscosity at corresponding Temperature (Pa · s) and Changing rate of complex viscosity within the range of 120° C. to 160° C. (Pa · s) (Measured angular velocity 1.6 rad/s/10 rad/s) | | | |
|---|---|---|---|---|
| | 120° C. | 140° C. | 160° C. | Δη*/ΔT |
| Example 1 | 7.75e3/3.56e3 | 2.00e3/9.97e2 | 1.01e3/4.73e2 | 169/77 |
| Example 2 | 7.81e3/3.61e3 | 2.10e3/1.02e3 | 1.12e3/4.85e2 | 168/78 |
| Example 3 | 7.93e3/3.23e3 | 2.55e3/8.70e2 | 1.31e3/4.23e2 | 165/70 |
| Comparative Example 1 | 7.31e3/3.55e3 | 1.81e3/7.70e2 | 8.70e2/4.01e2 | 161/78 |
| Comparative Example 2 | 9.25e3/4.32e3 | 2.75e3/1.31e3 | 2.56e3/6.72e2 | 167/91 |
| Comparative Example 3 | 8.12e3/3.75e3 | 1.94e3/8.05e2 | 6.70e2/3.65e2 | 186/85 |

Referring to Table 1, the toners of Examples 1 to 3 exhibited a reduction in the complex viscosity as the temperature and angular velocity at measurement increased, and had overall values within the range of 4e2 Pa·s to 8e3 Pa·s. In addition, it was verified that the rates of change of the complex viscosity with respect to temperature change Δη*/ΔT were in the range of 165 to 185 Pa·s/° C. at 1.6 rad/s, and 70 to 80 Pa·s/° C. at 10 rad/s.

Meanwhile, the toner manufactured according to Comparative Example 1, which used only a polyester-series resin with weight average molecular weight of 2,900 as a binder resin, was found to have a decreased complex viscosity than the toners of Examples 1, 2, and 3. Additionally, the toner manufactured according to Comparative Example 2, which used only a polyester-series resin with weight average molecular weight of 210,000, was found to have a significantly increased complex viscosity than the toners of Examples 1, 2, and 3.

In the case of the toner manufactured according to Comparative Example 3, where the first binder resin and the second binder resin with weight average molecular weights of 210,000 and 2,900 each were mixed at 6:4, but where the second binder resin had a significantly smaller molecular weight than that of Examples 1, 2, and 3 (weight average molecular weight 80,000), the complex viscosity was found to be drastically decreased as the measured temperature increased. This is attributed to the fact that the low molecular weight resin is sensitive to temperature and lowers a viscosity of the entire system.

<Evaluation of Stress Relaxation>

Stress relaxation was measured using an ARES measuring device by Rheometric Scientific. The time of measurement was 500 seconds, and keeping the range of temperature error within 1° C. since the initiation of measurement attained the measuring accuracy. A sample, in a form of a powder, was inserted between two round discs of 25 mm in diameter, and the stress relaxation was measured at a linear region.

The samples were measured directly in a powder form in order to minimize the addition/removal of heat by hysteresis during a preparation of sample discs, and to accurately measure properties of the prepared toner. The stress relaxation was measured at a strain of 5% or less. The results are illustrated in Table 2.

TABLE 2

| Samples | Stress Relaxation at Measured Temperature (Pa) and Changing rate of the stress relaxation within the range of 120° C. to 160° C. (Pa/° C.) (Relaxation time: 0.05 sec/0.3 sec) | | | |
|---|---|---|---|---|
| | 120° C. | 140° C. | 160° C. | ΔG/ΔT |
| Example 1 | 4.35e4/9.23e3 | 1.32e4/2.71e3 | 1.12e4/1.39e3 | 807/196 |
| Example 2 | 4.41e4/9.9e3 | 1.35e4/2.93e3 | 1.23e4/1.41e3 | 795/212 |
| Example 3 | 4.49e4/8.87e3 | 1.41e4/2.65e3 | 1.31e4/1.18e3 | 795/192 |
| Comparative Example 1 | 4.01e4/9.55e3 | 1.05e4/2.13e3 | 8.90e3/8.70e2 | 780/217 |
| Comparative Example 2 | 5.75e4/1.15e4 | 2.15e4/3.55e3 | 1.63e4/1.63e3 | 1030/247 |
| Comparative Example 3 | 4.87e4/9.31e3 | 1.51e4/2.73e3 | 7.10e3/6.12e2 | 1040/215 |

Referring to Table 2, the toners of Examples 1 to 3 had a stress relaxation value in the range of 1.0 e3 to 4.5 e4 Pa. In addition, the rates of change of stress relaxation with respect to temperature change ΔG/ΔT were found to be within the range of 785 to 1000 Pa/° C. at 0.05 seconds, and 190 to 215 Pa/° C. at 0.3 seconds.

Meanwhile, the toner manufactured according to Comparative Example 1, which used only a polyester-series resin with weight average molecular weight of 2,900 as a binder resin, was found to have a noticeably decreased stress relaxation value than the toners of Examples 1 to 3 at a high temperature condition (160° C.). Additionally, the toner manufactured according to Comparative Example 2, which used only a polyester-series resin with weight average molecular weight of 210,000, was found to have a significantly increased stress relaxation value than the toners of Examples 1 to 3 at a low temperature condition (140° C.).

Moreover, in the case of the toner manufactured according to Comparative Example 3, where the first binder resin and the second binder resin with weight average molecular weights of 210,000 and 2,900 each were mixed at 6:4, but where the second binder resin had a significantly smaller molecular weight than that of Examples 1 to 3 (weight average molecular weight of 80,000), the stress relaxation value was found to be drastically decreased as the measured temperature increased, in a similar manner as Comparative Example 1. This is due to the fact that the stress relaxation occurs rapidly as a temperature of a low molecular weight resin increases.

<Evaluation of Offset/Wrap Jam>

Evaluation of an offset/wrap jam was performed using a handmade tool made in the form of a jig, and an angular velocity of a heat roller is 2 to 10 rad/s, where a passing time of a first pressuring unit was adjusted to at least 0.05 sec and a passing time of the entire unit of the first and second pressuring units was adjusted to at most 0.3 sec. A 50-page consecutive printing was performed, and if the wrap jam did not occur and the image was stable, ○ was recorded; if the wrap jam did not occur but a small offset was detected, Δ was recorded; and if both the wrap jam and the offset occurred, × was recorded.

The results are illustrated in Table 3 below.

<Evaluation of Glossiness>

A glossiness was measured at a reflective angle of 60° using a Gardner microtriglossmeter (type 4430), and if the value was less than 3, × was recorded; if the value was from 3 to 5, Δ was recorded; and if the value was greater than 5, ○ was recorded.

The results are illustrated in Table 3 below.

<Fixability Test>

The fixability test was performed by tape-testing the image fixed at a fixing temperature of 175° C., and if an image density difference between before and after testing was 85% or greater, ○ was recorded; if the difference was from 75 to 85%, Δ was recorded; and if the difference was 75% or less, × was recorded. The results are illustrated in Table 3 below.

<Durability Test>

The durability test was performed by 0% printing 500 pages at a driving condition of 20 ppm and determining an appearance of a streak, such that if contamination did not occur, ○ was recorded; if there was some contamination but the contamination did not affect the image, Δ was recorded; and if there was a contamination that affects the image, × was recorded. The results are illustrated in Table 3 below.

TABLE 3

| Samples | Offset/Wrap Jam | Glossiness | Fixability | Durability |
|---|---|---|---|---|
| Example 1 | ○ | ○ | ○ | ○ |
| Example 2 | ○ | Δ | ○ | ○ |
| Example 3 | ○ | ○ | ○ | Δ |
| Comparative Example 1 | X | Δ | ○ | X |
| Comparative Example 2 | ○ | X | Δ | ○ |
| Comparative Example 3 | X | Δ | ○ | Δ |

Referring to Table 3, the toners according to Examples 1 to 3 received superior results above the standard in all categories of evaluation.

Meanwhile, offsetting/wrap jams were observed in the toners according to fixed images of Comparative Examples 1 and 3, and streaks were observed to allow to verify the durability below standard. This is attributed to the fact that the toners of Comparative Examples 1 and 3 all include a binder resin with a very small weight average molecular weight of 2,900, and because of the low durability of the low molecular weight resin.

Moreover, the toner of Comparative Example 2 has a significantly low glossiness and a decreased fixability. This is attributed to the fact that Comparative Example 2 used a binder resin with a large weight average molecular weight of 210,000, exceeding a viscosity value appropriate for a given temperature range.

Various embodiments of the present general inventive concept can provide an electrophotographic toner that can be applied in a fixation system with a multiple pressure configuration, has improved fixation properties, prevents an incidence of offsetting, has sufficient paper separability, and has improved glossiness and durability by controlling rheological characteristics of the toner.

While the present general inventive concept has been particularly illustrated and described with reference to exemplary embodiments thereof, it will be understood by one of ordinary skill in the art that various changes in form and details may be made therein without departing from the spirit and scope of the present general inventive concept as defined by the following claims.

What is claimed is:

1. An electrophotographic toner, comprising:

a binder resin having a weight-average molecular weight of 3,000 to 200,000 and a gel content of 1 to 10%, the binder resin being selected from the group consisting of polystyrene, poly-p-chlorostyrene, poly-α-methylstyrene, styrene-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinylmethylether copolymer, styrene-vinylethyl ether copolymer, styrene-vinylethylketone copolymer, styrene-butadiene copolymer, styrene-acrylnitrile-indene copolymer, styrene-maleate copolymer, and styrene-maleate ester, polymethyl methacrylate, polyethyl methacrylate, polybutyl methacrylate, copolymers thereof, polyvinyl chloride, polyvinyl acetate, polyethylene, polypropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, paraffin chloride, and paraffin wax, individually or as a mixture;

a colorant in an amount from about 0.1 to 20 parts by weight based on 100 parts by weight of the binder resin;

a releasing agent having a content of 1 to 4 parts by weight based on 100 parts by weight of the binder resin and having a melting point of approximately 50 to 150° C.; and a charge controlling agent selected from the group consisting of zinc or aluminum containing a salicylic acid compound, a boric complex of bis diphenyl glycolic acid, and silicate, wherein a complex viscosity (η) is $4\times10^2$ Pa·s to $8\times10^3$ Pa·s at a temperature range of 120 to 160° C. and an angular velocity range of 1.6 to 10 rad/s, a rate of change of the complex viscosity within the temperature range is 165 to 185 Pa·s/° C. at 1.6 rad/s, and 70 to 80 Pa·s/° C. at 10 rad/s, a stress relaxation at a relaxation time of 0.05 to 0.3 seconds under the temperature range of 120 to 160° C. is $1.0\times10^3$ to $4.5\times10^4$ Pa, and a rate of change of the stress relaxation (ΔG/ΔT) within the temperature range is 785 to 1000 Pa/° C. at 0.05 seconds and 190 to 215 Pa/° C. at 0.3 seconds, toner particles possessing a gloss of about 3 or greater when measured at a reflective angle of 60° using a gloss meter.

2. The electrophotographic toner of claim 1, wherein the binder resin comprises:

a first binder resin having a weight average molecular weight of 90,000 to 150,000 and a gel content of 5 to 10 wt %, and a second binder resin having a weight average molecular weight of 5,000 to 60,000 and a gel content of 1 to 3 wt %, wherein a weight ratio between the first binder resin and the second binder resin is 8:2 to 5:5.

* * * * *